US008142086B2

(12) United States Patent
Huang et al.

(10) Patent No.: US 8,142,086 B2
(45) Date of Patent: Mar. 27, 2012

(54) SEMICONDUCTOR MANUFACTURING PROCESS

(75) Inventors: Pei-Lin Huang, Taipei (TW); Yi-Ming Wang, Taoyuan County (TW); Chun-Yen Huang, Taoyuan County (TW)

(73) Assignee: Nanya Technology Corporation, Taoyuan (TW)

( * ) Notice: Subject to any disclaimer, the term of this patent is extended or adjusted under 35 U.S.C. 154(b) by 0 days.

(21) Appl. No.: 12/907,035

(22) Filed: Oct. 19, 2010

(65) Prior Publication Data

US 2011/0059622 A1 Mar. 10, 2011

Related U.S. Application Data

(62) Division of application No. 12/555,811, filed on Sep. 9, 2009, now Pat. No. 7,845,868.

(51) Int. Cl.
*G03D 5/00* (2006.01)

(52) U.S. Cl. ..... 396/571; 396/611

(58) Field of Classification Search ..... 396/571, 396/611

See application file for complete search history.

(56) References Cited

U.S. PATENT DOCUMENTS

| | | | | |
|---|---|---|---|---|
| 6,117,778 | A * | 9/2000 | Jones et al. | 438/692 |
| 6,599,366 | B1 * | 7/2003 | Kitano et al. | 118/666 |
| 6,695,922 | B2 * | 2/2004 | Kitano et al. | 118/667 |
| 6,753,508 | B2 * | 6/2004 | Shirakawa | 219/444.1 |
| 7,566,181 | B2 * | 7/2009 | Yang et al. | 396/575 |
| 2003/0001267 | A1 * | 1/2003 | Watanabe | 257/758 |
| 2003/0045121 | A1 * | 3/2003 | Higashi | 438/758 |
| 2003/0077083 | A1 * | 4/2003 | Yamamoto et al. | 396/611 |
| 2003/0114009 | A1 * | 6/2003 | Kim et al. | 438/697 |
| 2004/0067654 | A1 * | 4/2004 | Chen et al. | 438/706 |
| 2005/0284576 | A1 * | 12/2005 | America et al. | 156/345.43 |
| 2007/0003279 | A1 * | 1/2007 | Park | 396/611 |
| 2008/0241778 | A1 * | 10/2008 | Kulp | 432/5 |

FOREIGN PATENT DOCUMENTS

| | | |
|---|---|---|
| JP | 2000-349018 | 12/2000 |
| JP | 2003-203837 | 7/2003 |

OTHER PUBLICATIONS

"Office Action of Japan Counterpart Application", issued on Oct. 26, 2011, p. 1-p. 3.

* cited by examiner

*Primary Examiner* — W. B. Perkey
(74) *Attorney, Agent, or Firm* — Jianq Chyun IP Office

(57) ABSTRACT

A semiconductor manufacturing process is provided. First, a wafer with a material layer and an exposed photoresist layer formed thereon is provided, wherein the wafer has a center area and an edge area. Thereafter, the property of the exposed photoresist layer is varied, so as to make a critical dimension of the exposed photoresist layer in the center area different from that of the same in the edge area. After the edge property of the exposed photoresist layer is varied, an etching process is performed to the wafer by using the exposed photoresist layer as a mask, so as to make a patterned material layer having a uniform critical dimension formed on the wafer.

9 Claims, 7 Drawing Sheets

SEMICONDUCTOR MANUFACTURING PROCESS

CROSS-REFERENCE TO RELATED APPLICATION

This application is a divisional application of and claims the priority benefit of an application Ser. No. 12/555,811, filed on Sep. 9, 2009, now allowed. The entirety of each of the above-mentioned patent applications is hereby incorporated by reference herein and made a part of this specification.

BACKGROUND OF THE INVENTION

1. Field of Invention

The present invention relates to a semiconductor manufacturing process, and more particularly to a process for changing a property of an exposed photoresist layer by a track so as to compensate the subsequent processing effect.

2. Description of Related Art

Due to the rapid development of integrated circuits, minimizing the device dimension and increasing the integration level have become the mainstream in the semiconductor industry. Generally, a semiconductor device is fabricated by performing a series of processes including deposition processes, photolithography processes, etching processes, and ion implantation processes. The key technology to decide the critical dimension (CD) is in photolithography and etching.

A typical photolithography process is conducted with a photolithography tool including a track and a stepper (or a scanner). The photolithography process normally includes coating a photoresist layer on a material layer to be patterned with a coater unit of the track, partially exposing the photoresist layer by the stepper, post-exposure baking (PEB) the exposed photoresist layer with a PEB unit of the track, and developing the exposed photoresist layer with a developer unit of the track. Thereafter, an etching process is preformed to the material layer by using the developed photoresist layer as a mask, so as to transfer the patterns from the developed photoresist layer to the material layer.

Due to the non-uniform etching gas distribution, etching rates between wafer edge and center are different, resulting in different CD performance. One known method is to expose the wafer edge chips with different exposure energy, so as to compensate the difference of the post-etch critical dimensions between the edge and the center area of the wafer in advance. However, the compensation by the exposure tool cannot eliminate the variation of the critical dimension within one chip and may cause the undesired shot-related issue. Therefore, the yield and the performance of the semiconductor device are affected.

SUMMARY OF THE INVENTION

Accordingly, the present invention provides a semiconductor manufacturing process to compensate the difference of critical dimensions between an edge area and a center area of a wafer in an etching step.

The present invention provides a semiconductor manufacturing process. First, a wafer having an exposed photoresist layer formed thereon is provided, wherein the wafer includes a center area and an edge area. Thereafter, a property of the edge area of the wafer is varied.

According to an embodiment of the present invention, the property of the edge area of the wafer is varied by a track.

According to an embodiment of the present invention, the property includes temperature.

According to an embodiment of the present invention, a temperature difference between the center area and the edge area of the wafer is within about 5-20° C.

According to an embodiment of the present invention, after the wafer is provided, the semiconductor manufacturing process of the present invention further includes dispensing a developer onto the wafer.

According to an embodiment of the present invention, the property includes developer concentration.

According to an embodiment of the present invention, a difference of the developer concentration between the center area and the edge area of the wafer is within about 5%-15%.

According to an embodiment of the present invention, the exposed photoresist layer in the center area and the edge area of the wafer is previously exposed with the same exposure energy.

According to an embodiment of the present invention, the exposed photoresist layer in the center area and the edge area of the wafer is previously exposed with different exposure energies.

In view of the above, the semiconductor manufacturing process of the present invention can make a critical dimension of an exposed photoresist layer in an edge area different from that of the same in a center area by a track, so as to compensate the non-uniform etching gas distribution caused by the subsequent etching process. After the wafer edge property of the exposed photoresist layer is changed, a material layer under the exposed photoresist layer is patterned by using the exposed photoresist layer as a mask. Thus, a patterned material layer having a uniform critical dimension is formed on the wafer. Accordingly, the yield and the performance of the semiconductor device are enhanced. Further, the apparatus of the present invention includes a ring element, and the ring element can be integrated into a PEB unit or a developer unit of a track easily without the requisite of replacing any existing manufacturing equipment in the fabrication.

In order to make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
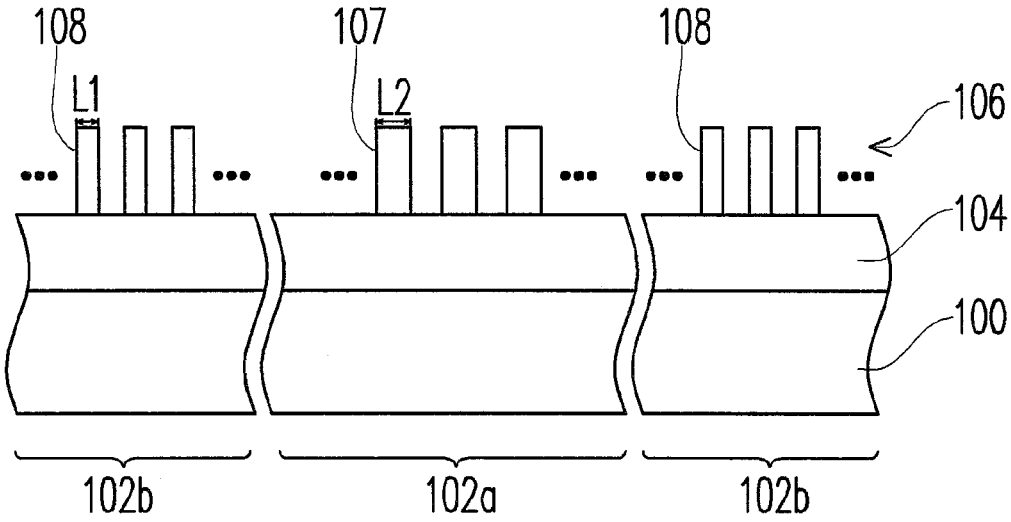
FIG. 1A to FIG. 1B schematically illustrate cross-sectional views of a semiconductor manufacturing process according to an embodiment of the present invention.
Figure 1B:
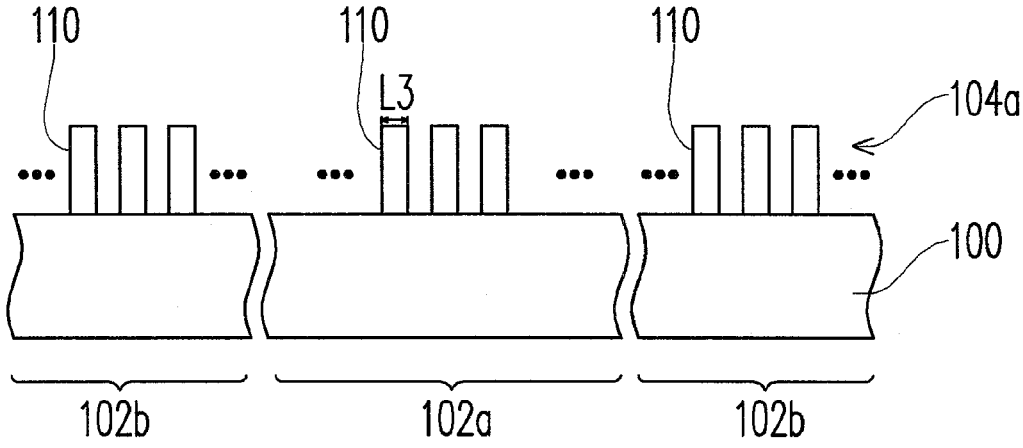
Figure 2:
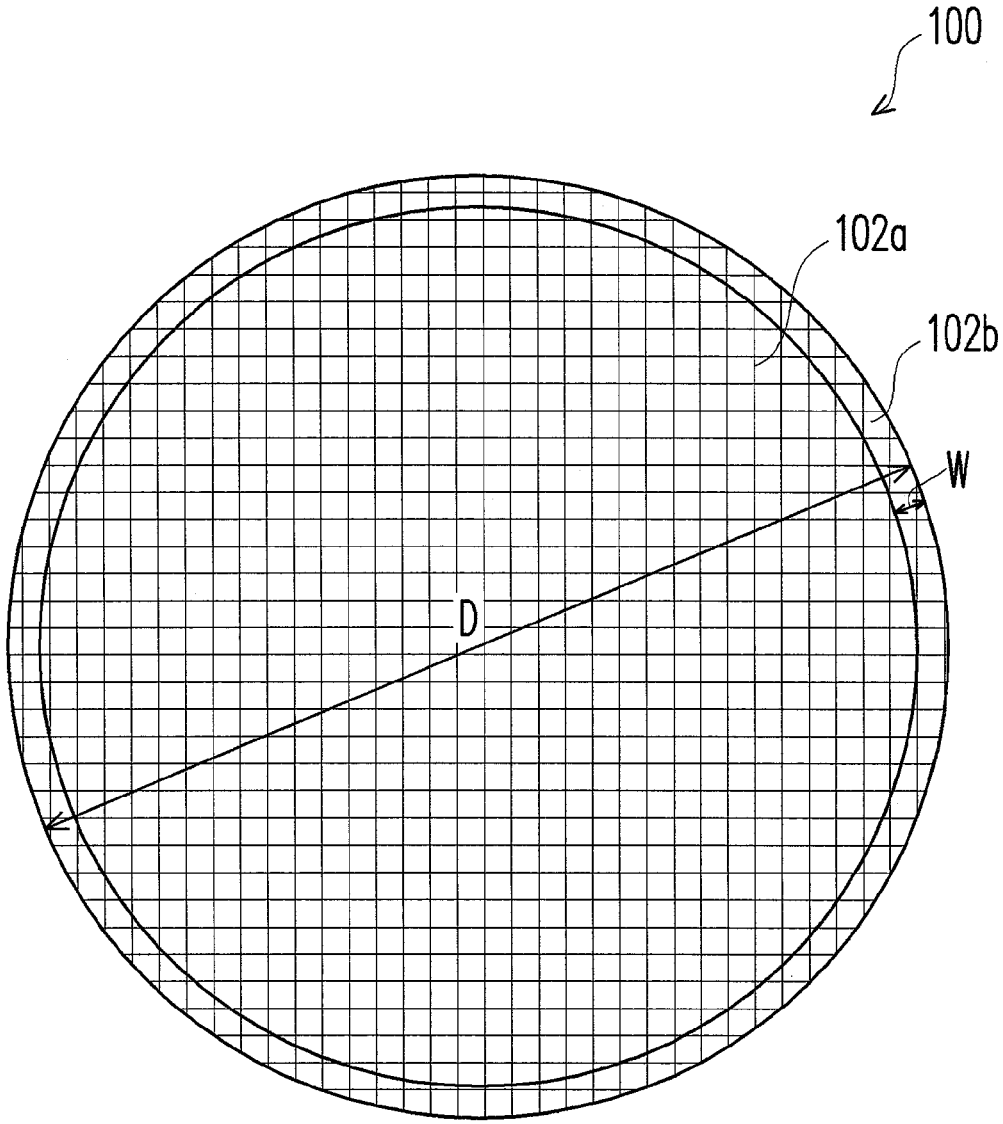
FIG. 2 is the top view of FIG. 1A.

FIG. 1A to FIG. 1B schematically illustrate cross-sectional views of a semiconductor manufacturing process according to an embodiment of the present invention. FIG. 2 is a top view of FIG. 1A.

Referring to FIG. 1A and FIG. 2, a wafer 100 including a center area 102*a* and an edge area 102*b* surrounding the center area 102*a* is provided. The edge area 102*b* is defined as a ring area with a width W of about 1/60 to 1/20 of a wafer diameter D, for example. In an embodiment, the ring area of the 12" wafer (300 mm diameter) has a width of about 5 mm to 15 mm. The wafer 100 has a material layer 104 and an exposed photoresist layer 106 formed thereon. The material layer 104 may be a conductive layer or a dielectric layer, and the exposed photoresist layer 106 includes a positive photoresist material, for example. In this embodiment, the exposed photoresist layer 106 in the center area 102*a* and the edge area 102*b* of the wafer 100 is previously exposed with the same exposure energy, but the present invention is not limited thereto. In another embodiment, the exposed photoresist layer 106 in the center area 102*a* and the edge area 102*b* of the wafer 100 can be previously exposed with different exposure energies as required. The wafer edge property of the exposed photoresist layer 106 can be varied by a track, so as to form patterns 108 in the edge area 102*b* and patterns 107 in the center area 102*a*. The line width L1 of the patterns 108 is narrower than the line width L2 of the patterns 107.

As described herein, the semiconductor manufacturing process of the present invention includes varying the wafer edge property of the exposed photoresist layer 106 by a track, so as to make the line width L1 of the exposed photoresist layer 106 in the wafer edge area 102*b* different from the line width L2 of the same in the center area 102*a*. In this embodiment, the line width L1 in the edge area 102*b* is smaller than the line width L2 in the center area 102*a*, but the present invention is not limited thereto. In another embodiment, the line width L1 in the edge area 102*b* can be greater than the line width L2 in the center area 102*a* as required.

The method of varying the property of the edge area of the wafer 100 by a track, for example but not limited to, will be described in the following. The property includes temperature. Specifically, the edge area 102*b* and the center area 102*a* of the exposed photoresist layer 106 are subjected to different post-exposure baking (PEB) temperatures, and the difference between the PEB temperatures is within about 5-20° C. In other words, the temperature difference between the edge area 102*b* and the center area 102*a* is within about 5-20° C. For example, the PEB temperature of the center area 102*a* is about 80-120° C., while the PEB temperature of the edge area 102*b* is about 70-130° C. The PEB temperature gradient is present at the interface between the edge area 102*b* and the center area 102*a* of the exposed photoresist layer 106. Specifically, the center area 102*a* and the edge area 102*b* of the exposed photoresist layer 106 are heated at a first temperature from under the wafer 100, the edge area 102*b* of the exposed photoresist layer 106 is additionally heated or cooled at a second temperature from under the wafer 100, and the first temperature is different from the second temperature. Alternatively, the center area 102*a* of the exposed photoresist layer 106 is heated at a first temperature under the center area of the wafer 100, the edge area 102*b* of the same is heated or cooled at a second temperature under the edge area of the wafer 100, and the first temperature is different from the second temperature. In this embodiment, the PEB temperature of the edge area 102*b* is higher than that of the center area 102*a*, so as to make the line width L1 in the edge area 102*b* smaller than the line width L2 in the center area 102*a*. In another embodiment, the PEB temperature of the edge area 102*b* can be lower than that of the center area 102*b* if the desired line width in the edge area 102*b* is greater than that in the center area 102*a*.

After the wafer providing process, the semiconductor manufacturing process further includes dispensing developer on the wafer 100, so as to vary the property of the edge area of the wafer 100. The property includes developer concentration. Specifically, the edge area 102*b* and the center area 102*a* of the exposed photoresist layer 106 are subjected to different developer concentrations, and the difference of the developer concentrations between the two areas is within about 5-15%, for example. The developer concentration gradient is present at the interface between the edge area 102*b* and the center area 102*a* of the exposed photoresist layer 106. Specifically, the first developer with a first concentration is dispensed to cover the whole surface of the exposed photoresist layer 106, a second developer with a second concentration is dispensed to cover the edge area 102*b* of the exposed photoresist layer 106, and the first concentration is different from the second concentration. In this embodiment, the developer concentration in the edge area 102*b* is higher than that in the center area 102*a*, so as to make the line width L1 in the edge area 102*b* smaller than the line width L2 in the center area 102*a*. In another embodiment, the developer concentration in the edge area 102*b* can be lower than that in the center area 102*b* if the desired line width in the edge area 102*b* is greater than that in the center area 102*a*.

The above-mentioned embodiment in which the line width of the exposed photoresist layer in the edge area is different from that of the same in the center area is provided for illustration purposes, and is not construed as limiting the present invention. It is appreciated by persons skilled in the art that in a conductive plug process, the critical dimension of the exposed photoresist layer in the edge area can be different from that of the same in the center area upon the requirement. For example, the PEB temperature of the edge area 102*b* can be higher (or lower) than that of the center area 102*b* if the desired critical dimension in the edge area 102*b* is greater (or smaller) than that in the center area 102*a*. Alternatively, the developer concentration in the edge area 102*b* can be higher (or lower) than that in the center area 102*b* if the desired critical dimension in the edge area 102*b* is greater (or smaller) than that in the center area 102*a*. In addition, these two approaches of changing the PEB temperature or developer concentration for different areas (i.e. edge area and center area) can be used in combination or separately upon the requirement.

Referring to FIG. 1B, after the wafer edge property of the exposed photoresist layer 106 is varied, the wafer 100 is sent to an etching module. The material layer 104 is patterned by using the exposed photoresist layer 106 as a mask. The different etching rates due to the non-uniform etching gas distribution compensate the difference of the critical dimensions between the edge area 102*b* and the center area 102*a* of the exposed photoresist layer 106. Thus, a patterned material layer 104*a* having uniform patterns 110 with a line width L3 is formed on the wafer 100. The line width L3 can be smaller than, equal to, or greater than the line width L2. As described herein, the semiconductor manufacturing process of the present invention further includes performing an etching process to the wafer 100 by using the exposed photoresist layer 106 as a mask, so as to make the line width L3 uniform across the wafer 100.

As described above, the present invention provides a semiconductor manufacturing process for compensating the etching effect in advance. That is, the critical dimension in a wafer edge area is formed differently from that in a wafer center area by a track in a photolithography process. Since the etching rates are different in the edge area and in the center area, the formed critical dimension turns out to be uniform across the wafer after the etching process. Thus, the semiconductor manufacturing process of the present invention resolves the variation of the critical dimension resulted from the etching chamber and avoids the shot-related issue caused by the conventional compensation method with a stepper.

In addition, the present invention is illustrated with the embodiment in which a positive photoresist material is used, but is not limited thereto. It is appreciated by persons skilled in the art that a negative photoresist material can be used as required. Since the property of a positive photoresist material is opposite to that of a negative photoresist material, the variation of a line width (or a critical dimension) affected by the change of the PEB temperature or developer concentration is in a reverse trend as compared to the foregoing embodiments.

Further, the present invention is illustrated with the embodiment in which the wafer has a center area and an edge area, but is not limited thereto. It is appreciated by persons skilled in the art that the wafer can have a first area and a second area, and the arrangements of the first area and the second area are adjusted depending on the etching gas distribution in a subsequent etching process. For example, the first area can be an upper half area of the wafer, and the second area can be a lower half area of the wafer.

Figure 3A:
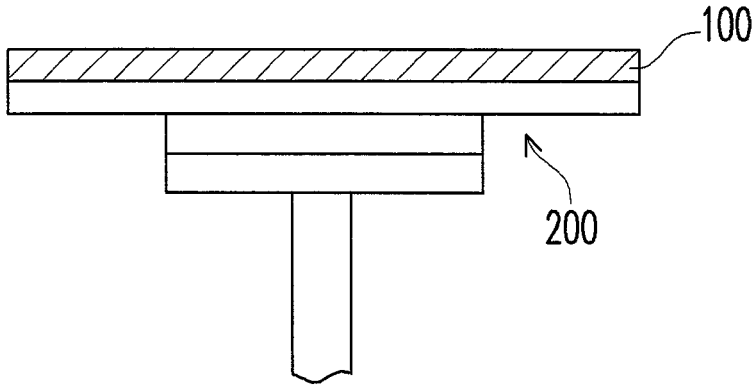
FIG. 3A to FIG. 3C schematically illustrate cross-sectional views of operation of an apparatus in which a ring element is integrated into a post-exposure baking unit of a track according to an embodiment of the present invention.
Figure 3B:
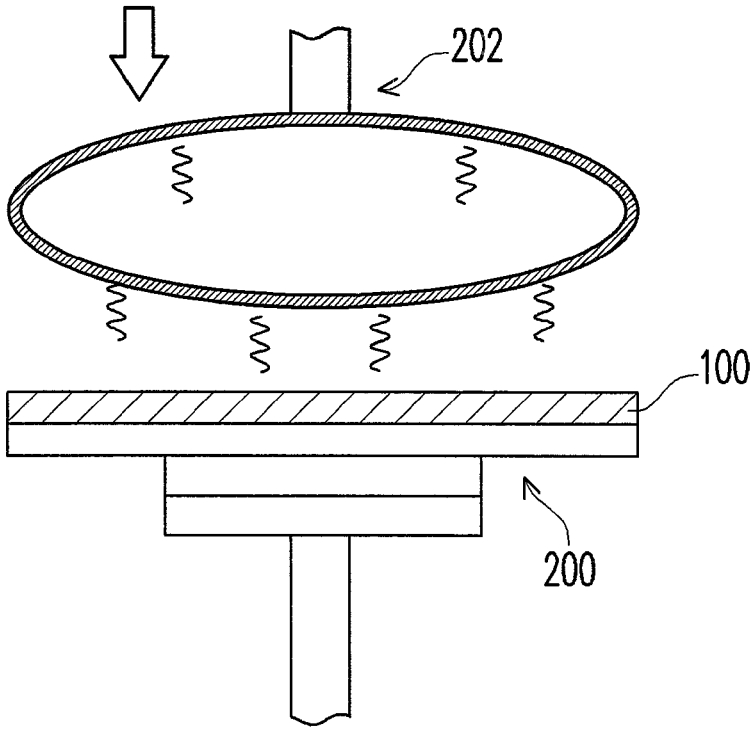
Figure 3C:
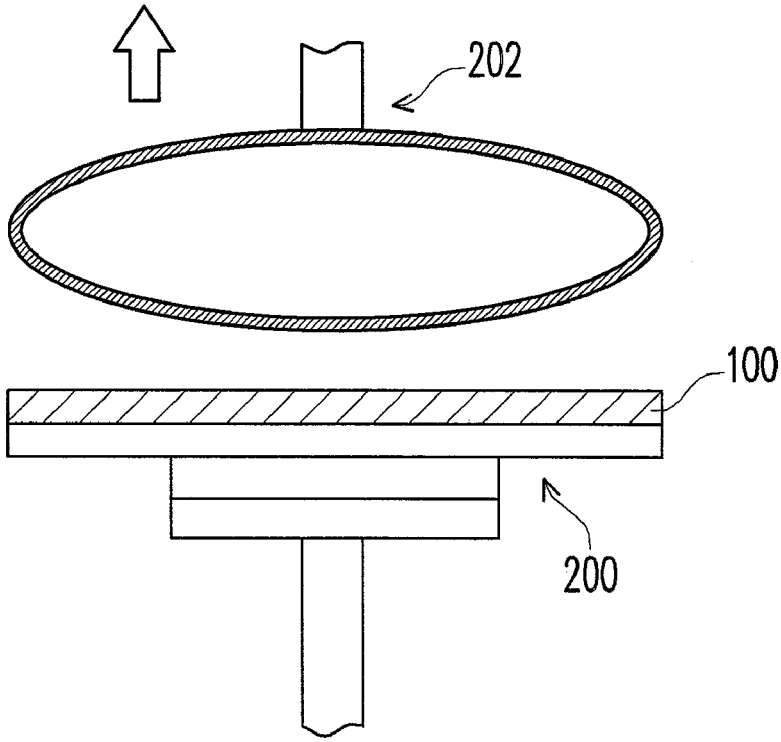

The apparatus for the above-mentioned semiconductor manufacturing process will be introduced in the following. A ring element is integrated into a unit of a track, so as to vary the property of an edge area of a wafer. For purposes of convenience and clarity only, the following embodiment in which the desired line width of an exposed photoresist layer in a wafer edge area is smaller than that of the same in a wafer center area is provided as an example, but is not intended to limit the present invention. The difference of line widths between a wafer edge area and a wafer center area of an exposed photoresist layer can be achieved by a ring element integrated into a PEB unit of a track. FIG. 3A to FIG. 3C schematically illustrate cross-sectional views of operation of an apparatus in which a ring element is integrated into a PEB unit of a track according to an embodiment of the present invention.

Referring to FIG. 3A, a wafer 100 having a material layer (not shown) and an exposed photoresist layer (not shown) thereon is transferred to a PEB unit 200 after a coating step and an exposure step. The backside of the wafer 100 is in contact with the heating surface of the PEB unit 200. A post-exposure baking recipe including at least two steps is performed as follows. In a pre-heating step, the whole wafer 100 is heated at 90° C. for 10 seconds. Thereafter, referring to FIG. 3B, a main heating step is performed. A ring element 202 is moved down to an active position for additionally heating the edge area of the wafer 100. The edge area of the wafer 100 is designed as a ring area with a width of about 1/60 to 1/20 of a wafer diameter. The main heating step is performed under the condition in which the whole wafer 100 is heated with the PEB unit 200 at 90° C. for 50 seconds, and the edge area of the wafer 100 is additionally heated with the ring element 202 on the top at 100° C. for 50 seconds. In other words, the PEB temperature in the edge area of the wafer 100 is higher than that in the center area of the wafer 100. Afterwards, referring tot FIG. 3C, the ring element 202 is moved up to an idle position and the wafer 100 is then transferred out of the PEB unit 200. Further, the wafer 100 is transferred to a developer unit for development and followed by a hard baking unit. As a result, due to the ring element 202 and the PEB unit 200 have different heating temperatures to the wafer 100, the desired line width of the exposed photoresist layer in the edge area is smaller than that of the same in the center area.

Figure 4:
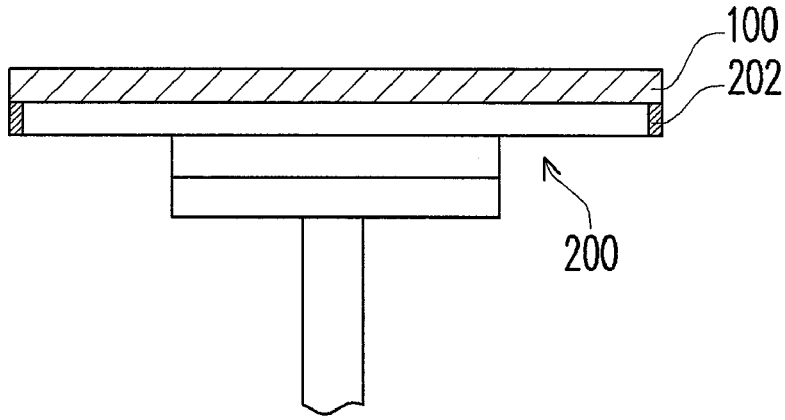
FIG. 4 schematically illustrates a cross-sectional view of an apparatus in which a ring element and a post-exposure baking unit is manufactured as a whole piece according to an embodiment of the present invention.

In this embodiment, the ring element 202 is configured to disposed above the wafer 100, the ring element 202 is not in contact with the top surface of the wafer 100, and the ring element 202 and the PEB unit 200 are manufactured separately. However, the present invention is not limited thereto. In another embodiment, the ring element 202 is configured to disposed below the wafer 100, the ring element 202 is in contact with the backside of the wafer 100, and the ring element 202 and the post-exposure baking unit 200 are manufactured as a whole piece, as shown in FIG. 4.

Alternatively, the difference of line widths between an edge area and a center area of a wafer can be achieved by a ring element integrated into a developer unit of a track. FIG. 5A to FIG. 5E schematically illustrate cross-sectional views of operation of an apparatus in which a ring element is integrated into a developer unit of a track according to an embodiment of the present invention, wherein the right bottom side of FIG. 5D is a partially enlarged view.

Figure 5A:
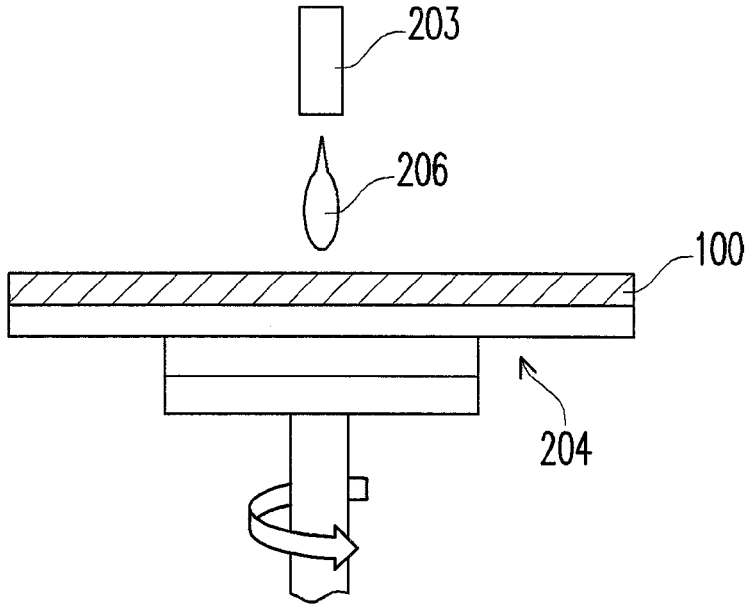
FIG. 5A to FIG. 5E schematically illustrate cross-sectional views of operation of an apparatus in which a ring element is integrated into a developer unit of a track according to an embodiment of the present invention, wherein the right bottom side of FIG. 5D is a partially enlarged view.
Figure 5B:
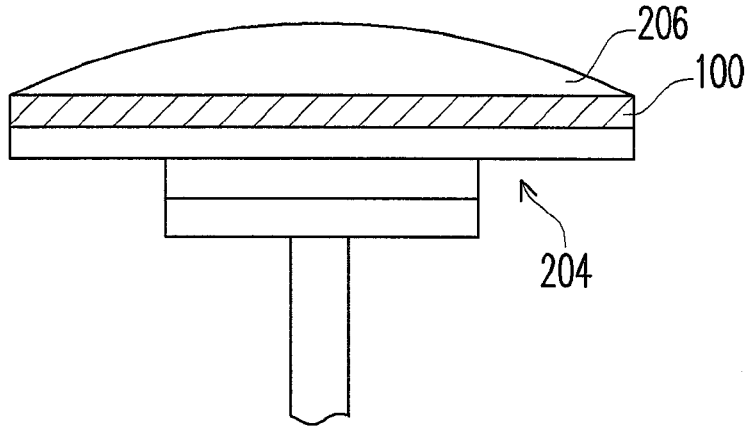
Figure 5C:
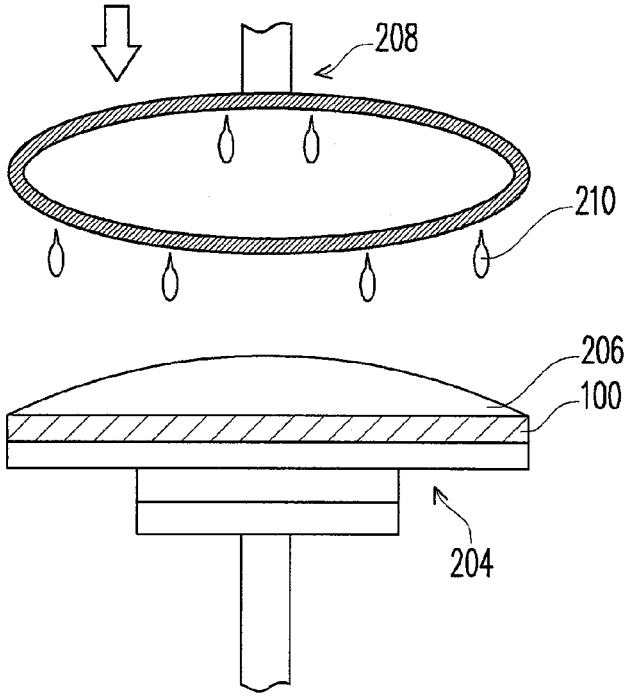
Figure 5D:
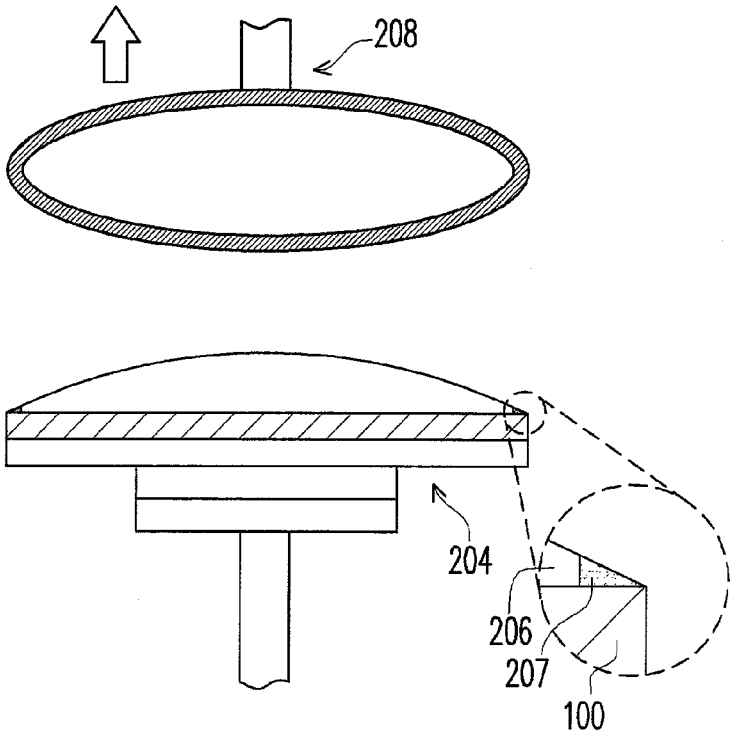
Figure 5E:
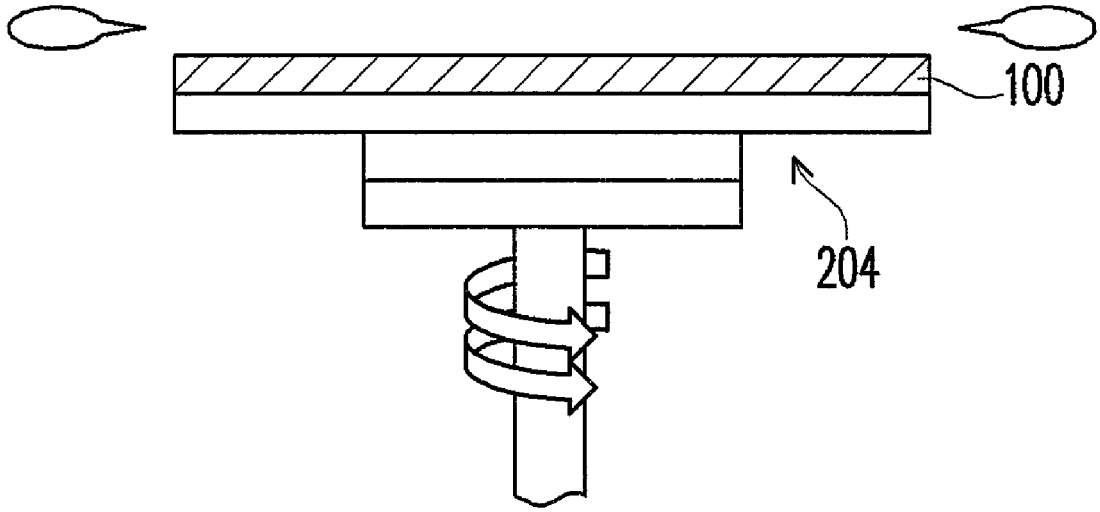

Referring to FIG. 5A, a wafer 100 having a material layer (not shown) and a photoresist layer (not shown) thereon is transferred to a developer unit 204 after a coating step, an exposure step and a post-exposure baking step. A developer recipe including at least five steps is performed as follows. In the first dispensing step, a nozzle 203 of the developer unit 204 dispenses a developer 206 on the wafer 100. The developer unit 204 rotates gently to assure that the whole surface of the wafer 100 is covered with the developer 206. Thereafter, referring to FIG. 5B, a first static puddle step is performed. The wafer 100 is covered with the developer 206 for 2-10 seconds. Afterwards, referring to FIG. 5C, a second dispensing step is performed. A ring element 208 is moved down to an active position to dispense a developer 210 on the edge area of the wafer 100. The concentration of the developer 210 is about 10% higher than that of the developer 206. Further, referring to FIG. 5D, a second static puddle step is performed for 10-40 seconds. The ring element 208 is moved up to an idle position at this step. The edge area of the wafer 100 is covered with a mixture 207 of the developer 206 and the developer 210, and the center area of the wafer 100 is covered with the developer 206. In other words, the developer concentration in the edge area of the wafer 100 is higher or lower than that in the center area of the wafer 100. Then, referring to FIG. 5E, the developer unit 204 is rotated for 20-50 seconds to spin the developer 206 and the developer 210 out of the wafer 100. Thereafter, the wafer 100 is transferred from the developer unit 204 to a hard baking unit. As a result, due to the ring element 208 and the developer unit 204 provide different developer concentrations to the wafer 100, the desired line width of the exposed photoresist layer in the edge area is smaller than that of the same in the center area.

The above embodiment in which the element 202 or 208 is shaped as a ring is provided for illustration purposes, and is not construed as limiting the present invention. It is appreciated by persons skilled in the art that the shape of the element 202 or 208 can be any shape suitable for the apparatus of the present invention. For example, the element 202 can be shaped as a plate having a plurality of heating sections, and the temperatures of the heating sections can be controlled independently.

In summary, the semiconductor manufacturing process of the present invention can make a critical dimension in a wafer edge area different from that in a wafer center area by a track so as to compensate the subsequent processing effect. In other words, the critical dimension distribution caused by the PEB temperature or developer concentration distribution within one wafer compensates the etching gas distribution in the etching process. Therefore, the critical dimension is uniform across the wafer after the etching step, and the yield and the performance of the semiconductor device are enhanced.

Further, the apparatus of the present invention includes a ring element, and the ring element can be integrated into a PEB unit or a developer unit of a track easily, so as to change the edge property of the wafer. The modification is simple and easy without replacing any existing manufacturing equipment in the fabrication.

This invention has been disclosed above in the preferred embodiments, but is not limited to those. It is known to persons skilled in the art that some modifications and innovations may be made without departing from the spirit and scope of this invention. Hence, the scope of this invention should be defined by the following claims.

What is claimed is:

1. A semiconductor manufacturing process comprising:

providing a wafer, the wafer having an exposed photoresist layer formed thereon, wherein the wafer comprises a center area and an edge area; and varying a first critical dimension of the exposed photoresist layer in the edge area different from a second critical dimension of the exposed photoresist layer in the center area of the wafer.

2. The semiconductor manufacturing process of claim 1, wherein the first critical dimension and the second critical dimension of the exposed photoresist layer is varied by a track.

3. The semiconductor manufacturing process of claim 1, wherein the exposed photoresist layer is subjected to different temperatures.

4. The semiconductor manufacturing process of claim 3, wherein a temperature difference between the center area and the edge area is substantially within 5-20° C.

5. The semiconductor manufacturing process of claim 1, after the wafer is provided, further comprising:

dispensing a developer onto the wafer.

6. The semiconductor manufacturing process of claim 5, wherein the exposed photoresist layer is subjected to different developer concentrations.

7. The semiconductor manufacturing process of claim 6, wherein a difference of the developer concentration between the center area and the edge area is substantially within 5-15%.

8. The semiconductor manufacturing process of claim 1, wherein the exposed photoresist layer in the center area and the edge area of the wafer is previously exposed with the same exposure energy.

9. The semiconductor manufacturing process of claim 1, wherein the exposed photoresist layer in the center area and the edge area of the wafer is previously exposed with different exposure energies.

* * * * *